United States Patent [19]

Sprinkle

[11] Patent Number: 4,798,011

[45] Date of Patent: Jan. 17, 1989

[54] VERSATILE TRACTOR SIDE BLADE MOUNT

[76] Inventor: Charles R. Sprinkle, 10580 Creek Rd., Ojai, Calif. 93023

[21] Appl. No.: 128,153

[22] Filed: Dec. 3, 1987

[51] Int. Cl.[4] ..... E02F 5/00

[52] U.S. Cl. ..... 37/108 R; 37/283; 37/236; 37/104; 37/DIG. 3; 172/459; 172/684.5

[58] Field of Search ..... 37/108 R, 105, 281, 37/103, 207, 236, 283, DIG. 3; 172/445.1, 445.2, 684.5, 691, 491, 830, 831, 815, 822, 825, 446–447, 782, 784, 793, 795, 786, 476, 477, 459, 460

[56] References Cited

U.S. PATENT DOCUMENTS

| | | | |
|---|---|---|---|
| 1,987,729 | 1/1935 | Bash | 172/784 |
| 2,856,709 | 10/1958 | Brockly . | |
| 3,019,536 | 2/1962 | Kershaw | 37/104 |
| 3,044,196 | 7/1962 | Kinney | 172/491 |
| 3,146,686 | 9/1964 | Grace et al. | 172/460 |
| 3,523,380 | 8/1970 | Bolyard et al. | 172/684.5 |
| 3,720,010 | 3/1973 | Coates . | |
| 3,797,582 | 3/1974 | Couch | 172/445.2 |
| 3,805,424 | 4/1974 | Renshan . | |
| 3,908,289 | 9/1975 | Ross | 172/459 |
| 4,045,892 | 9/1977 | Farrell . | |
| 4,096,652 | 6/1978 | Raines et al. . | |
| 4,314,789 | 2/1982 | Luigi | 37/103 |
| 4,369,590 | 1/1983 | Miller | 37/231 |
| 4,579,178 | 4/1986 | Dover | 172/459 |
| 4,643,358 | 2/1987 | Jackson | 172/459 |

*Primary Examiner*—Eugene H. Eickholt

*Attorney, Agent, or Firm*—Poms, Smith, Lande & Rose

[57] ABSTRACT

A tractor side blade mount includes a control member, a blade holding bracket, a blade, a joint member for mounting the blade on the blade holding bracket, and a pair of hydraulically actuated arms for independently positioning the control member and the bracket. As a result of selected positioning of the control member and the bracket, the blade, which is mounted at one end of the bracket, may take up various angles, heights and lateral displacements with respect to the body of the tractor. The versatility in the movement of the blade results in an increased capability to grade earth, scrape dirt, or dig trenches alongside structures and in areas which would otherwise be out of reach of a conventionally equipped tractor.

14 Claims, 2 Drawing Sheets

FIG. 1
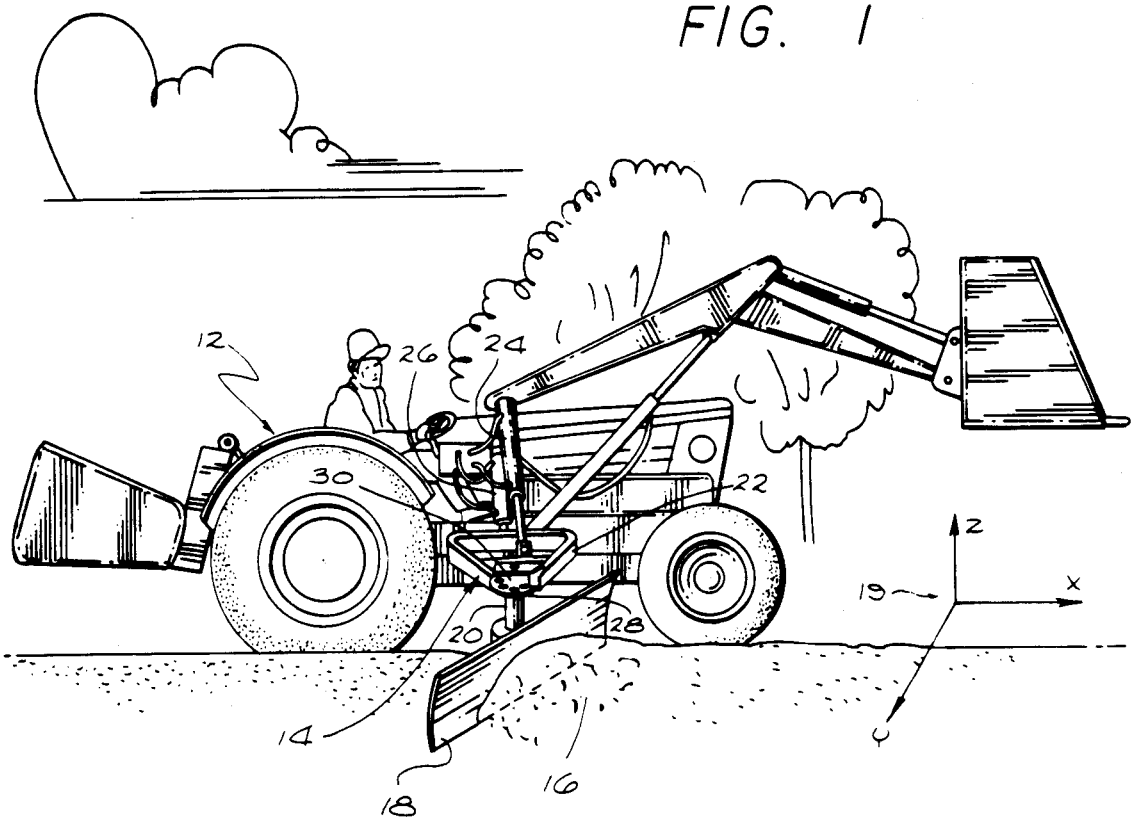
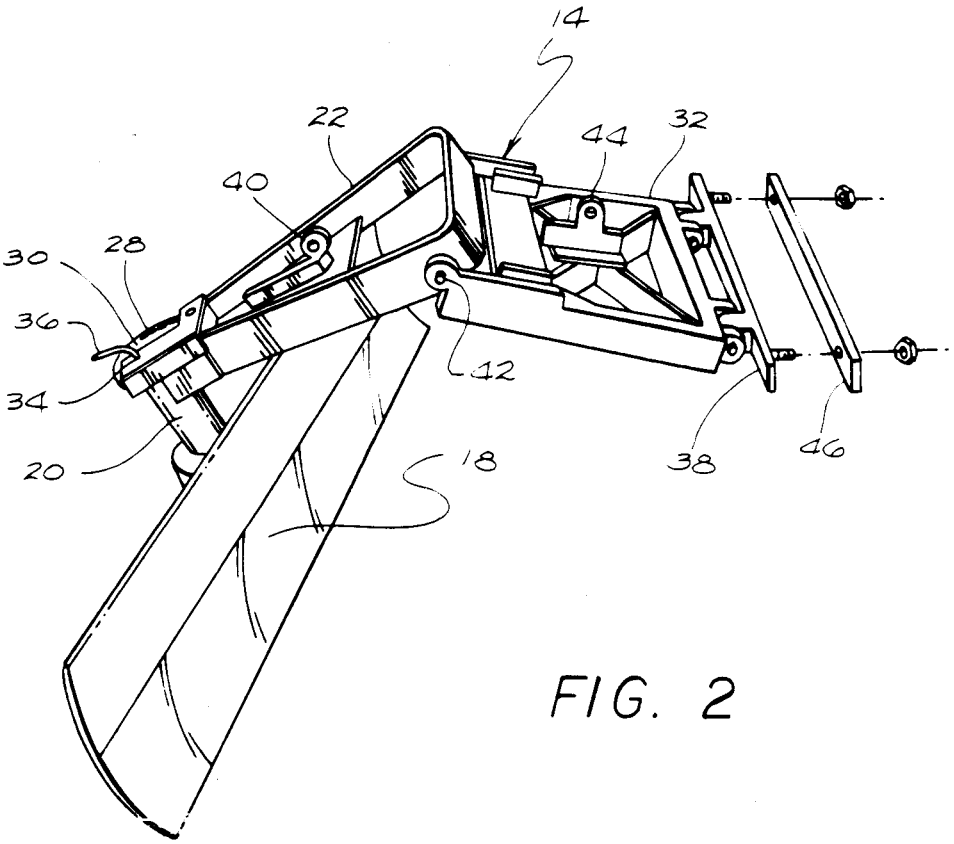
FIG. 2

VERSATILE TRACTOR SIDE BLADE MOUNT

FIELD OF THE INVENTION

This invention relates to tractor side blade mounts.

BACKGROUND OF THE INVENTION

In the field of grading or moving earth or dirt, the so called side blade attachments for a tractor are an economical way of grading earth, sweeping dirt, snow or other material, or digging trenches. Unfortunately, due to the constraints on the movements of the side blade, the reach of the side blade is very limited. For areas that are outside the reach of the side blade, a person with a pick and a shovel usually undertakes the extremely time consuming and costly task of moving dirt or grading earth.

A tractor with a side blade mounted underneath its body is a convenient tool for removing snow or moving dirt. It may also be used for grading or ditching areas adjacent the body of the tractor. Major drawbacks of having the side blade underneath the body of the tractor, however, are the constraints that the body of the tractor puts on the movements of the blade. As a result of this structural constraint, the blade has limited angular, vertical and lateral movement.

Undesirable constraints on the angular movements of the blade with respect to a horizontal plane arise from the position of the blade mounted underneath the body of the tractor. Since the blade may not be rotated at wide angles, and the tractor must traverse the surface being graded, grading earth or moving dirt at relatively steep angles is not practical.

Undesirable constraints on the vertical movements of the blade are also present because the blade may be raised only to the extent of open space underneath the tractor. In other words, the space underneath the tractor is the extent of the vertical movement of the blade. Therefore, in certain instances where there is a need to raise the blade high enough to pass over an object or an obstacle to reach the intended working area, the constraint on the vertical movement of the blade precludes accomplishing the work under consideration. Thus the blade may not be raised high enough to reach areas that are beyond an obstacle, such as a wall, that separates the tractor from the desired working area. This type of situation may come up where the tractor is used near a house or other types of constructions where the intended working area is not easily accessible by the tractor.

Undesirable constraints on lateral movements of the blade, away and towards the body of the tractor, also arise from the fact that the blade is attached underneath the tractor. Basically, the blade may be extended outward by an arm mechanism that rotates the blade about a vertical plane. In such a configuration, the blade will achieve its maximum outreach when it is rotated at an angle perpendicular to the body of the tractor.

Due to the above mentioned constraints, in many occasions, the tractor is not capable of moving dirt, grading earth, or digging a trench in an area alongside a construction, or beyond an obstacle, because neither the tractor nor the blade may get close enough to reach the intended working area. Further, grading or sweeping may not be performed at relatively steep angles approaching the vertical.

Accordingly, a principal object of the present invention is to provide a versatile side blade and mount assembly to provide for significant capabilities to move dirt, grade earth, or dig trenches, at a wide array of blade orientations, angles, and heights, in areas which would otherwise be outside of the reach of a tractor or front end loader.

SUMMARY OF THE INVENTION

In accordance with the present invention, extreme versatility in the positioning of a tractor side blade for grading or the like, is achieved by the use of doubly articulated mounting arrangement for the blade, in which a control mounting member and a blade bracket (to which the blade is adjustably mounted) provide two successive pivot axes, both substantially parallel to the front-to-rear axis of the tractor, for controlling the angular orientation and position of the blade, to achieve surprisingly versatile angular positioning and orientations of the blade.

More specifically, a side blade mount in accordance with the present invention includes a control member rotatably mounted on one side of the tractor, a blade holding bracket (hereinafter bracket) rotatably mounted on the control member, a joint member mounted on the bracket for attaching the blade, at selected predetermined horizontal angles, to the blade holding bracket, a blade mounted on the joint member, a powerful control arm which may include a hydraulic cylinder, connected to the control member for moving the control member about the axis of rotation of the control member, and a powerful control arm which may include a second hydraulic cylinder connected to the bracket for moving the bracket about the axis of rotation of the bracket.

The significant freedom in lateral, vertical, and angular movements of the blade is mainly due to the versatility in the movements of the control member and the bracket. Further, the absence of physical obstructions, such as the body of the tractor, allow the blade to move freely at virtually any desired height and angle with respect to the tractor.

The versatility in the lateral movement of the blade is achieved through the versatility in the motion of the bracket and the control member about their axis of rotation. The control arms attached to the bracket and the control member may be used to exert a pushing or a pulling force on these elements to achieve a desired lateral displacement. Maximum lateral displacement is obtained when the control member and the bracket are extended horizontally and are substantially aligned with each other. In this case, the lateral displacement is approximately equal to the sum of the length of the control member and the length of the bracket.

Smaller lateral displacement may be achieved by moving the control member or the bracket or both away from a horizontal position. This may be achieved by rotating the control member or the bracket or both upwards or downward. In this case, the lateral displacement is approximately equal to the sum of (1) the length of the control member multiplied by the cosine of the acute angle it forms with the horizon, and (2) length of the bracket multiplied by the cosine of the angle it forms with the horizon.

The versatility in the vertical movement of the blade is also achieved by the versatility in motion of the bracket and the control member to effectuate in a desirable vertical displacement. The effective vertical displacement of the blade is approximately equal to the sum of vertical displacement of the control member and the vertical displacement of the bracket. For large vertical displacements, both the bracket and the control member may be rotated upwards. If viewed from the rear of the tractor, or by the operator, such a rotation would be a counter-clockwise rotation.

The versatility in horizontal and vertical angular movement of the blade is yet another feature of the invention. The vertical angular rotation, with respect to a horizontal plane, of the blade is achieved by moving the control member and the bracket about their axis of rotation. Since the position of the blade is fixed with respect to the position of the bracket, the blade follows the angular orientation of the bracket, which may be rotated at a wide spectrum of angles about its axis of rotation.

The angular orientation, with respect to a vertical plane, of the blade may be predetermined prior to the operation of the tractor. This is achieved by mounting the joint member on the bracket at a specific predetermined angle with respect to a vertical plane.

Since, during the operation of the side blade mount apparatus, the position of the blade is fixed with respect to the position of the bracket, the angular, vertical, and lateral movements of the blade follow that of the bracket. Since the bracket, through the cooperation of the control member and the two control arms responsible for moving the bracket and the control member, has significant latitude in moving laterally, vertically, and angularly, the blade is provided with significant capabilities to perform these movements.

As a result, the invention provides for significantly greater capabilities for scraping dirt, grading earth, or digging trenches, at a wide array of blade orientations, angles, and heights, in areas which would otherwise be outside of the reach of a tractor.

Other objects, features and advantages of the invention will become apparent from a consideration of the following detailed description and from the accompanying drawings.

BRIEF DESCRIPTION OF THE DRAWINGS

FIG. 1 is a side view of a tractor equipped with a versatile side blade mount illustrating the principles of the invention;

FIG. 2 is a perspective view of a side blade mount, showing the control member, the bracket, the joint member, and the blade;

DETAILED DESCRIPTION

Figure 3:
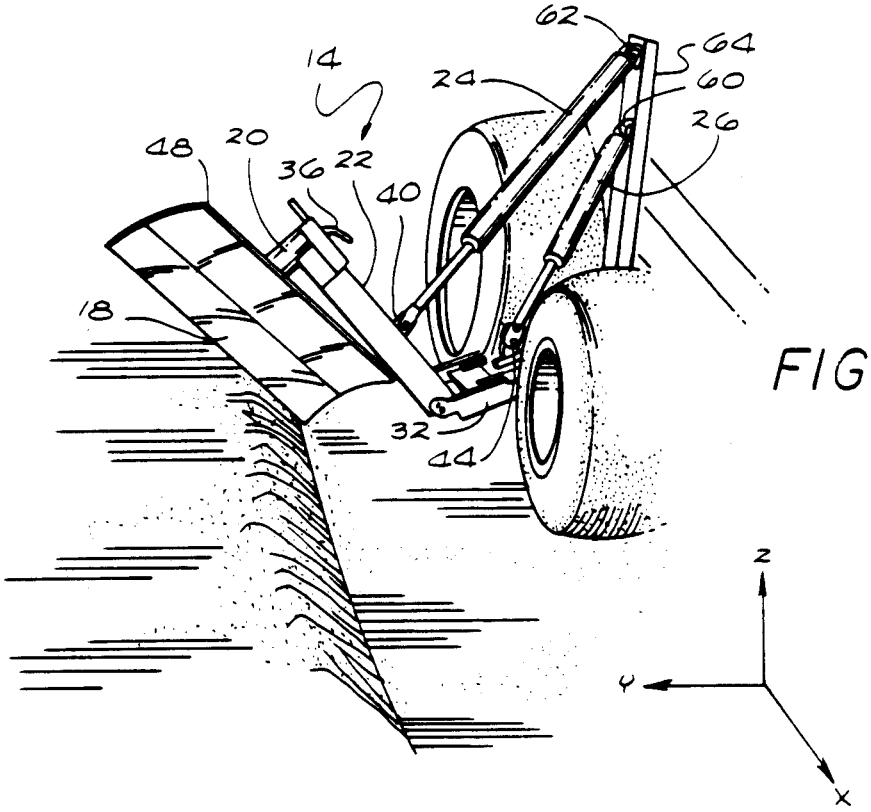
FIG. 3 is a partial perspective view of a tractor equipped with a versatile side blade mount, with the blade raised, rotated and laterally extended away from the body of the tractor.

Referring more particularly to the drawings, FIG. 1 is a side view of a tractor 12 equipped with a side blade mount 14, illustrating the principles of the invention. As shown in FIG. 1, a side blade mount 14 is used for grading earth 16. The outer end of blade 18 is rotated at an angle to the left of the XZ vertical plane and at an angle below the XY horizontal plane, with the x, y and z directions being indicated at 19, in FIG. 1.

The blade 18, which is positioned outside of the body of the tractor 12, is attached to the side blade mount assembly 14 using the joint member 20. The joint member 20 is mounted onto the bracket 22 via a bolt and nut assembly 36 (see FIG. 2). The blade 18 may be rotated, to a predetermined angle, about the Z axis, and then fixed to the bracket 22 using the bolt and nut assembly 36. There are several openings 28 on the surface 30 of the joint member 20 which may be aligned with the opening 34 on the surface of the bracket 22 (see FIG. 2). Then a bolt 36 is used to hold the joint member 20 in the selected angular orientation relative to bracket 22.

FIG. 2 is a perspective view of the side blade mount 14, illustrating the control member 32, the bracket 22, the joint member 20 and the hinge 38. Hydraulically actuated arm 24 as shown in FIG. 1 is pivotally connected to bracket 22 at locatin 40. The arm 24, which preferably includes a hydraulic piston unit, is used to exert a pushing or a pulling force on the bracket 22 and cause it to rotate about its axis of rotation 42. Hydraulically actuated arm 26 is connected to control member 32 at swivel point 44. The arm 26 exerts a pushing or a pulling force on the control member 32, and causes it to rotate about hinge 38 which is its axis of rotation. It may be noted in passing that the axes of rotation of control number 32 and bracket 22 are substantially parallel to one another, and to the front-to-rear longitudinal axis of the tractor.

The hinge assembly 38 is mounted through holes through the frame of the body of the tractor 12 with the reinforcing plate 46 on the other side of the frame. Additional bracing for the frame and the supporting member 64 for the arms 24 and 26 may also be provided.

FIG. 3 is a partial perspective view of a tractor equipped with a side blade mount assembly 14. Joint member 20 is mounted on bracket 22 at a predetermined angle with respect to the XZ vertical plane which is normal to the ground and is parallel to the wheels of the tractor. The edge 48 of blade 18 is normally substantially parallel to surface of bracket 22 (see FIG. 4A) because joint member 20 is mounted substantially perpendicular to the surface of bracket 22 and to the edge 48 of blade 18.

As illustrated in FIG. 3, arm 26 is mounted between the control member 32 and the tractor 12, extending between swivel points 44 and 60, respectively. Similarly, arm 24 is mounted between bracket 22 and tractor 12, at swivel points 40 and 62, respectively. As mentioned above, the frame member 64 may be reinforced to hold the assembly 14 firmly, without undue vibration.

Arm 26 has rotated the control member 32 downward, or clockwise as viewed from the rear of the tractor. Arm 24 has rotated the bracket 22, upward or counterclockwise as viewed from the rear of the tractor. Since the position of the blade 18 is fixed with respect to the position of bracket 22, the blade 18 is also positioned at an orientation similar to that of bracket 22. With the inner control member 32 depressed, and the bracket 22 tilted up, the blade 18 is tilted up, and may be located at the proper height and angular orientation.

Figure 4A:
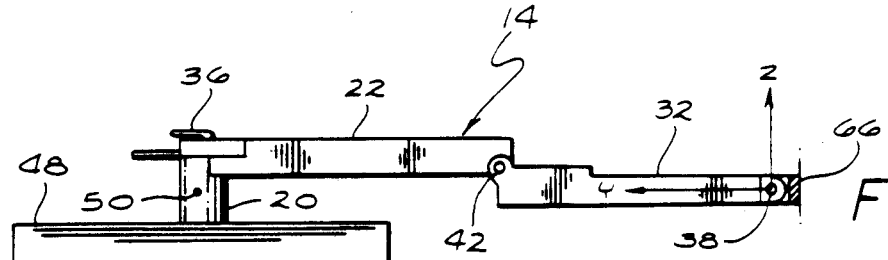
FIG. 4A is a schematic side view of the side blade mount, showing the control member, bracket and blade, all in a substantially horizontal orientation.

FIG. 4A is a schematic side view of side blade assembly 14 showing control member 32, bracket 22 and blade 18, all at a substantially horizontal position. Control member 32 rotates, in the YZ plane, about its axis of rotation 38 which is substantially parallel to the X axis, which is parallel to the front-to-rear longitudinal axis of the tractor. This motion is caused by exertion of a pushing or pulling force by arm 26 on control member 32 (see FIG. 3). Bracket 22 also rotates, in the YZ plane, about its axis of rotation 42 which is also substantially parallel to the X axis.

The edge 48 of blade 18 is normally substantially parallel to bracket 22. As shown in FIG. 4A, blade 18 has been tightened onto bracket 36 at a position substantially parallel to the Y axis (perpendicular to the tractor), and the surface of the bracket. At this position, the side blade mount 20 achieves its largest lateral displacement, which is equal to the sum of the length of the control member and that of the bracket. The vertical displacement of the side blade mount may be viewed at point 50 as compared to reference point 66 at the tractor. In this case the vertical displacement or position of point 50 is substantially the same as that of point 66, or they are at the same elevation or height.

Figure 4B:
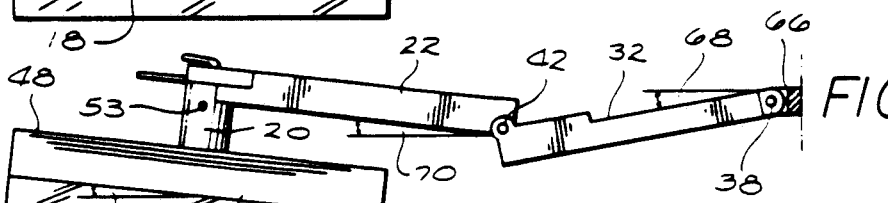
FIG. 4B is another schematic side view of the side blade mount, with the center of the blade substantially at the same vertical displacement as in FIG. 4A, but with the outer end of the blade tilted upward.

FIG. 4B is another schematic side view of side blade mount assembly 14. In this example, control member 32 has been rotated downward, pointing below the XY horizontal plane, about its axis of rotation 38. Bracket 22 has been rotated upward, pointing above the XY horizontal plane, about its axis of rotation 42.

Figure 4C:
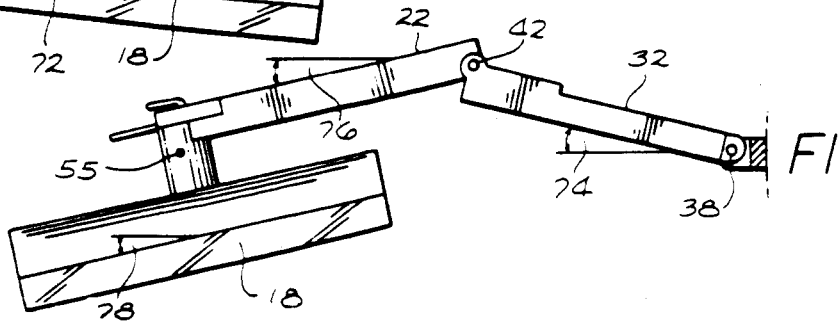
FIG. 4C is yet another schematic side view of the side blade mount, with the center of the blade substantially at the same vertical and lateral displacement as in FIG. 4B, but with the outer end of the blade tilted downward.

FIGS. 4B and 4C show how the angle of the blade may be controlled by moving the control member 32 and bracket 22. Thus in FIG. 4B the outer end of the blade 18 is tilted up by depressing control member 32 and raising bracket 22. The opposite effect, i.e. tilting the outer end of the blade down, may be accomplished as shown in FIG. 4C by raising control arm 32 and lowering the bracket 22. With relatively small angles, as shown in FIGS. 4B and 4C, the blade is not moved forward or away from the tractor to any significant extent; while with greater angles of inclination of the member 32 and 22, the blade would be moved closer to the tractor. In the following portion of the specification, a more precise analysis of the position of the blade will be undertaken.

The net lateral displacement of point 50 with respect to point 66 is substantially equal to the sum of horizontal components of the lengths of the bracket 22 and the control member 32 as defined below. The horizontal component of length of the control member 32 is equal to the product of the length of the control member multiplied by the cosine of angle 68 that it makes with the Y axis, with the cosine being equal to 1.0 when the members are horizontal. Similarly, the horizontal length of the bracket 22 is equal to the product of the length of the bracket multiplied by the cosine of angle 70 that it makes with the horizontal Y axis. Since the cosine of an acute angle decreases in magnitude as the angle gets closer to 90 degrees, the horizontal length of the bracket 22 and the control member 32 decrease as the angle 68 and 70 get closer to positive or negative 90 degrees. Therefore in this case of FIG. 4B, the lateral displacement of point 50 with respect to point 66 is smaller than that of point 50 in FIG. 4A.

The net vertical displacement of point 50 with respect to point 66 is substantially equal to the sum of vertical components of length of the bracket 22 and the control member 32 as defined below. The vertical length of the control member 32 is equal to the product of the length of the control member multiplied by sine of angle 68 that it makes with the horizontal Y axis. Similarly, the vertical component of length of the bracket 22 is equal to the multiplication product of the length of the bracket and the sine of angle 70 that it makes with the Y axis. The sign of the vertical length for the bracket 22 is positive because the sine of angle 70 is positive, and the sign of vertical length for control member 32 is negative because the sine of angle 68 is negative. Since the sine of an acute angle increases in magnitude as the angle gets closer to positive or negative 90 degrees, the vertical components of length of the bracket 22 and the control member 32 increase as the angle 68 and 70 get closer to positive or negative 90 degrees.

In FIG. 4B, the angles 68 and 70 are such that the net vertical displacement of point 50 with respect to point 66 is substantially equal to zero. Therefore point 50 in FIG. 4B is at the same height as that in FIG. 4A. As a result, the height of the side blade mount is equal in FIG. 4A and FIG. 4B, with the blade 18, in FIG. 4B, rotated at an angle 72 with respect to the horizontal, or Y axis.

FIG. 4C is yet another schematic side view of side blade mount assembly 14. Control member 32 is rotated upwards or clockwise, as shown in FIG. 4C, pointing above the XY horizontal plane, about its axis of rotation 38. Bracket 22 is rotated downward or counterclockwise, as shown in FIG. 4C, pointing below the XY horizontal plane, about its axis of rotation 42.

Since the angles 74 and 76 are substantially equivalent in magnitude but opposite in sign with respect to angles 68 and 70 in FIG. 4B, respectively, points 53 and 55 are at substantially the same vertical displacement or height as 66. Similarly, points 53 and 55 are at substantially the same (small) lateral displacement with respect to point 66, in FIG. 4B and FIG. 4C, respectively. The blade 18 forms an angle 78 with the horizontal Y axis. This angle is substantially equal to angle 76 because the bracket 22 and the blade 18 are substantially parallel.

Although points 53 and 55 are at substantially the same vertical and horizontal positions, angles 72 and 78, which are of substantially equal magnitude, have opposite signs, resulting in an opposite orientation of the blade with respect to the XY horizontal plane.

One major advantage of the invention is the substantially increased speed and substantially reduced cost of accomplishing certain tasks such as the preparation of a driveway apron. A driveway apron cannot be formed using only a tractor with a conventional front and rear brackets, but requires in addition a man equipped with a pick and shovel. A tractor equipped with a side blade mount in accordance with the present inventor is capable of completing the task of grading a driveway apron, and cleaning alongside a road, in about half an hour. Assuming an hourly rate of $40 or $50 per hour, this project would approximately cost $25.

If the present invention is not utilized by the tractor, a person with a pick and a shovel is needed to complete the task, because a conventionally equipped tractor is not capable of performing the task. For this apron grading, the costs and the time to perform the grading job for a driveway apron is increased to approximately 4 hours. Assuming a rate of $50/hr. for a tractor and a person with a pick and shovel, the cost is raised to $200, while the time spent in completing the task is increased to 4 hours.

For completeness, reference is made to U.S. Pat. Nos. 2,856,709; 3,720,010; 3,805,424; 4,045,892; and 4,096,652, which were found in a search of the invention. These patents show various mounting arrangements for tractor and snow plow blades, but none show or suggest the versatile doubly articulated, side blade mount assembly of the invention.

In conclusion, it is to be understood that the foregoing detailed description and the accompanying drawings illustrate the principles of the invention. However, various changes may be made without departing from the spirit and scope of the invention. Thus by way of example and not of limitation, the control member may be formed in a triangular or a square shape, the bracket may be formed in a rectangular configuration, the hydraulic arms may be replaced by similar types of powerful mechanical or electrical devices, and the joint member may be mounted on the bracket by means other than a bolts and nuts. Accordingly, the present invention is not limited to the side blade mount systems shown in the drawings and described in detail hereinabove.

What is claimed is:

1. A versatile tractor side blade mount system for use with a tractor comprising:

a control member including means for pivotally mounting said member on at least one side of said tractor;

a grading blade;

a blade holding bracket pivotally mounted on said control member;

joint member means for mounting said blade at an adjustably predetermined angle on said bracket;

means for rotating said blade holding bracket about its axis of rotation with respect to said control member;

means for rotating said control member about its axis of rotation with respect to the tractor;

the axis of rotation of said control member involving said means for pivotally mounting said control member being substantially parallel to the axis of rotation of said bracket with both of these axes extending in a predetermined direction, and said axes of rotation being spaced apart by a predetermined distance;

the distance between the axis of rotation of said bracket and said joint means being of the same order of magnitude as said predetermined distance; and said control member having a significantly greater extent in the direction parallel to said predetermined direction than in the direction perpendicular to the plane defined by said two axes of rotation; and said bracket having a significantly greater extent in the direction parallel to said axes of rotation than in the direction perpendicular to the plane defined by the axis of rotation of said bracket and the point of securing said joint member means to said bracket;

whereby said control member and said blade holding bracket may be rotated about their axes of rotation, and position said blade at a wide spectrum of angles, heights with respect to the tractor, and lateral distances from the body of the tractor.

2. A versatile tractor side blade mount system as defined in claim 1 wherein said control member and bracket rotate in substantially the same plane.

3. A versatile tractor side blade mount system as defined in claim 1 wherein said joint member means is substantially perpendicular to the plane of said bracket.

4. A versatile tractor side blade mount system as defined in claim 1 wherein said blade extends substantially parallel to said bracket.

5. A versatile tractor side blade mount system as defined in claim 1 wherein the axes of rotation of said bracket and said control member are both substantially parallel to a horizontal plane, and to the longitudinal axis of the tractor.

6. A versatile tractor side blade mount system as defined in claim 1 wherein said joint member means includes mounting means for mounting said blade on said bracket at various angles with respect to said bracket.

7. A versatile tractor side blade mount system as defined in claim 6 wherein said mounting means for mounting said joint member means on said bracket includes several openings, and locking means for extending through one of said openings to hold said blade at the desired angle.

8. A versatile tractor side blade mount system as defined in claim 1 wherein said means for rotating said control member includes a hydraulic piston.

9. A versatile tractor side blade mount system as defined in claim 1 wherein said means for rotating said bracket includes a hydraulic piston.

10. A versatile blade mount system as defined in claim 1 wherein said means for rotating said control member and said means for rotating said bracket are located in a substantially vertical plane.

11. A versatile tractor side blade mount system as defined in claim 1 wherein said control member is rectangular in configuration and said bracket is substantially triangular.

12. A system as defined in claim 1 including a tractor having a frame and further comprising reinforcing means for strengthening the frame of the tractor adjacent the location where said control member is mounted to said tractor.

13. A versatile tractor side blade mount system for use with a tractor comprising:

a control member including means for pivotally mounting said member on at least one side of said tractor;

a grading blade;

a blade holding bracket pivotally mounted on said control member;

joint member means for mounting said blade at an adjustably predetermined angle on said bracket;

means for rotating said blade holding bracket about its axis of rotation with respect to said control member;

means for rotating said control member about its axis of rotation with respect to the tractor; and said control member being rectangular in configuration and said bracket being substantially triangular, whereby said control member and said blade holding bracket rotate about their axis of rotation, and position said blade at a wide spectrum of angles, heights with respect to said tractor, and lateral distances from the body of said tractor.

14. A versatile tractor side blade mount system for use with a tractor comprising:

a control member including means for rotatably mounting said member on at least one side of said tractor;

a grading blade;

a blade holding bracket pivotally mounted on said control member;

joint member means for mounting said blade at an adjustable predetermined angle on said bracket;

means for rotating said blade holding bracket about its axis of rotation with respect to said control member;

means for rotating said control member about its axis of rotation with respect to the tractor said control member and bracket rotating in substantially the same plane of motion;

said joint member means being substantially perpendicular to the plane of said bracket;

the edge of said blade being substantially parallel to said bracket; and said control member being rectangular in configuration and said bracket being substantially triangular, whereby said control member and said bracket rotate about their axis of rotation, and position said blade at a wide spectrum of angles, heights with respect to the tractor, and lateral distances from the tractor.

* * * * *